US005498094A

United States Patent [19]

Imai

[11] Patent Number: 5,498,094

[45] Date of Patent: Mar. 12, 1996

[54] DOUBLE STEEL PIPE STRUCTURAL MEMBER

[75] Inventor: Katsuhiko Imai, Ashiya, Japan

[73] Assignee: Kawatetsu Kenzai Kogyo Kabushiki Kaisha, Hyogo, Japan

[21] Appl. No.: 248,931

[22] Filed: May 25, 1994

[30] Foreign Application Priority Data

Jun. 4, 1993 [JP] Japan ..... 5-160443

[51] Int. Cl.[6] ..... E04B 1/34; E04B 1/38

[52] U.S. Cl. ..... 403/171; 403/169; 403/41; 52/167.3; 52/655.1

[58] Field of Search ..... 403/171, 170, 403/169, 176, 217, 41; 52/167.3, 81.3, 655.2, 655.1

[56] References Cited

U.S. PATENT DOCUMENTS

| | | | |
|---|---|---|---|
| 2,149,844 | 3/1939 | George | 403/169 X |
| 2,970,388 | 2/1961 | Yonkers | 403/171 X |
| 3,864,049 | 2/1975 | Ono | 403/217 X |
| 3,981,114 | 9/1976 | Chupick . | |
| 4,281,487 | 8/1981 | Koller . | |
| 4,872,779 | 10/1989 | Imai | 403/171 |
| 5,141,351 | 8/1992 | Imai | 403/171 |

FOREIGN PATENT DOCUMENTS

| | | | |
|---|---|---|---|
| 2564911 | 11/1985 | France | 403/171 |
| 4269250 | 9/1992 | Japan | 52/655.1 |
| 2248862 | 4/1992 | United Kingdom . | |

*Primary Examiner*—Anthony Knight
*Attorney, Agent, or Firm*—Jordan and Hamburg

[57] ABSTRACT

A double steel pipe structural member comprises an external pipe and an internal pipe. The external pipe is provided with a thin steel pipe part and thick steel pipe parts formed at each of the ends of the thin part. The thickness of the thick part is 1.5 to 1.7 times the thickness of the thin part. The internal pipe is disposed so as to overlap not only with the thin part but with the thick part of the external pipe. The internal pipe behaves as a bending resistant pipe against the external pipe so that the external pipe may deform plastically in the longitudinal direction thereof after an axial compressive force exceeds the yield strength of the external pipe. The deformation is axially symmetrical along the outer surface of the internal pipe. A truss structure including the double steel pipe, is prevented from immediately collapsing when a building having the truss structure encounters a big earthquake or the like.

4 Claims, 11 Drawing Sheets

DOUBLE STEEL PIPE STRUCTURAL MEMBER

BACKGROUND OF THE INVENTION

The present invention relates to a double steel pipe structural member for use in a truss or brace structure and, more particularly, to a structural member with high resistance to elastic and plastic buckling and which is capable of large controlled axial plastic deformation under high compressive loads.

In constructing a large structure by using a large number of structural members comprising long steel pipes, connection of the structural members with nodes enables a space truss structure. In order to join radially a plurality of structural members to spherical nodes provided with several fastening portions a joint device equipped with a fastening bolt, movable in the axial direction of the structural member, is used.

Such joint devices which tightly connect steel pipes to nodes are disclosed in U.S. Pat. No. 4,872,779 and U.S. Pat. No. 5,141,351.

Each device substantially comprises a fastening bolt having a threaded part engaged with a screw hole of a connector node and a sleeve slidably engaged with a polygonal boss formed on the intermediate part of the bolt. Rotation of the sleeve advances the fastening bolt, mounted in the end of the structural member, toward the node.

When a truss structure assembled by structural members is covered with heavy snow or is present during a large earthquake, axial compressive load is communicated to any steel pipe member through the nodes joined to both ends thereof. A large compressive load promotes elastic and plastic buckling of structural members, and in general, the strength of a single steel pipe decreases immediately as shown by a double dotted chain line A in FIG. 11 and, thus, the truss structure will quickly collapse.

U.S. Pat. No. 4,281,487 discloses a double steel pipe member to control buckling of elongated structural members and to shorten the overall length of the structural member by means of the predetermined plastic axial deformation of the external pipe after an axial compressive force exceeds a yield strength thereof. Both the external and internal steel pipes can oppose the axial compressive force which successively acts on the structural member and can promote an earthquake-proof character of the truss structure.

A structural member similar to the above is disclosed in GB 2,248,862 A, which is provided with an external pipe 44 and an internal pipe 55 inserted therein as seen in FIG. 10. Such a member comprising a double steel pipe is joined to nodes 3 using a joint device 51 installed on end cap 66 closing the end of the external pipe 44.

The clearance between an outer surface of the internal pipe 55 and an inner surface of the external pipe 44 is made as small as possible and the length of space 11 between an end face of the internal pipe 55 and an inner face of the end cap 66 is defined as one-half of the predetermined compressive deformation β allowable for the external pipe 44.

Even when an axial compressive load P acts on the external pipe 44, the external pipe 44 is prevented from deforming in the direction orthogonal to the longitudinal axis 44*m* thereof by means of the internal pipe 55 behaving as a bending resistant pipe, whereby, the elastic and plastic deformation of the pipe 44 is suppressed. The external pipe 44 is plastically shortened in the direction of the longitudinal axis thereof only along the outer surface of the internal pipe 55.

On the other hand, once the external pipe 44 is largely compressed, both ends of the internal pipe 55 will contact the inner faces of the end cap 66 as shown by double dotted chain lines. Thereafter, a resultant force obtained by adding the strength of the internal pipe 55 to the residual strength of the external pipe 44 resists the succeeding axial compressive force acting thereon so that the double steel pipe never immediately deforms.

Since the afore-mentioned double pipe initially has no resistant members within the space 11, an initial plastic deformation by means of the axial compressive force occurs close to the end cap 66. The deformation of the end portion of the external pipe 44 becomes unstable and axially unsymmetrical. Therefore, the external pipe 44 is forced to bend near the node 3. The appearance of partial bending of the external pipe hinders the introduction of axial force only to the double steel pipe in a truss structure.

In addition, unstable deformation of the external pipe 44 never achieves a desired shrinkage in the axial direction equal to the predetermined compressive deformation β allowable therefor. Consequently, the end face of the external pipe 55 can not contact the inner face of end cap 66, which means the strength of the internal pipe 55 is of no utility as shown by broken line B in FIG. 11 indicating an immediate decrease of the strength of the steel pipe just after the beginning of the plastic deformation.

An object of the present invention is to propose a double steel pipe structural member to suppress elastic and plastic deformation of an external pipe when an axial compressive load is acting thereon.

Another object is to prevent the external pipe from bending locally against an axial compressive force more than the yield strength thereof, to facilitate a large compressive deformation of the external pipe in the axial direction thereof, and to enable the structural member to withstand the axial compressive force by means of maintaining the plastic deformation capacity when the axial force acting on the steel pipe becomes more than the yield load thereof, thus, preventing a truss structure from immediately collapsing.

SUMMARY OF THE INVENTION

The invention relates to a double steel pipe structural member which has an external pipe joined to a node by a fastening bolt and an internal pipe, which is resistant to bending, inserted therein.

The external pipe comprises an elongated thin steel pipe part and thick steel pipe parts integrated with both ends of the thin steel pipe part. The thickness of the thick steel pipe part, integrated with an end cap for mounting a fastening bolt, is selected to be 1.5 to 1.7 times the thickness of the thin steel pipe part. The clearance between the inner surface of the external pipe and the outer surface of the internal pipe is selected to be as small as possible. The intermediate portion in the axial direction of the internal pipe is fixed to that of the external pipe. The length of each space between the end face of the internal pipe and the inner face of the end cap is defined as one-half of the predetermined axial compressive deformation allowable for the external pipe. The length which the thick steel pipe part overlaps with the internal pipe is selected to be one to two times the outer diameter of the external pipe.

According to the present invention, a pipe resistant to bending helps to avoid elastic and plastic deformation of the structural pipe. The thick steel pipe part of the external pipe deforms elastically and the thin steel pipe part shrinks plastically along the internal steel pipe when the axial compressive load becomes larger than the yield strength of the thin steel pipe. As a result, the structural pipe never bends near the end cap, and the axial force is only introduced into a double steel pipe.

The axial load acting on the double steel pipe is resisted by the strength of the internal pipe and the residual strength of the external pipe after the external pipe is shrunk by a predetermined length. The truss structure never collapses immediately, even if the elongated thin steel pipe is deformed plastically, so that the occupants of a building may escape even after they discover a large deformation of the truss structure.

DETAILED DESCRIPTION OF THE INVENTION

Figure 1:
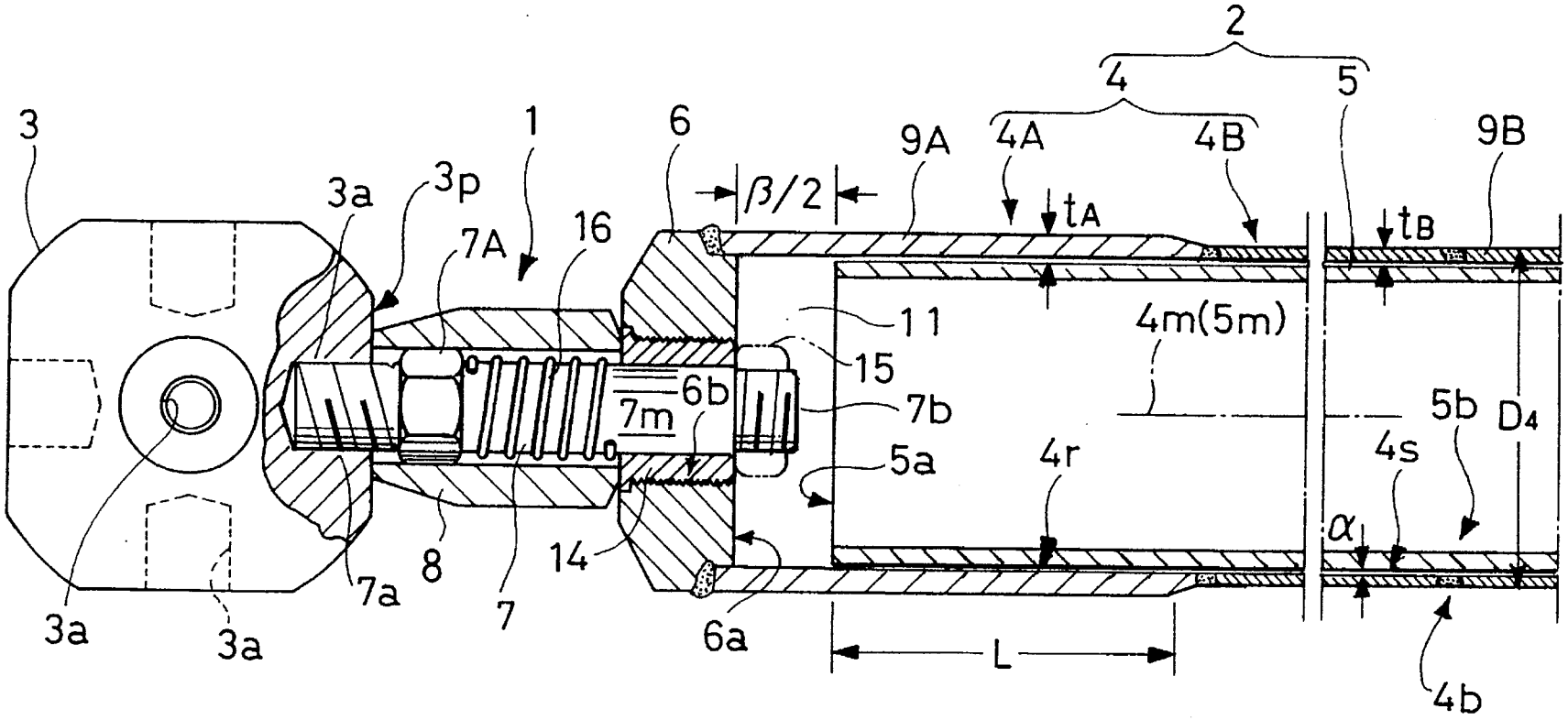
FIG. 1 is a longitudinal sectional view of one side of the double steel pipe structural member of the present invention.

FIG. 1 is a longitudinal sectional view on the left hand side of a double steel pipe 2 connected to a node 3 by using a joint device 1. The double steel pipe 2 comprises a long steel pipe 4 and a bending resistant pipe 5 inserted therein so that the elastic and plastic deformation in a direction orthogonal to the longitudinal axis 4*m* of the pipe 4 is suppressed by a resistant effect of the internal pipe 5 when an axial compressive force acts on the steel pipe 4.

The double steel pipe structural member is joined tightly to the node 3 by advancing a fastening bolt 7, mounted on the end cap 6 closing the end of steel pipe 4, according to the rotation of the sleeve 8 axially slidably engaged with the boss 7A formed on the bolt 7.

The afore-mentioned steel pipe 4 comprises an elongated thin steel pipe part 4B and a short thick steel pipe part 4A welded to both ends of pipe part 4B. It is preferable that the inner surface 4*r* of thick part 4A integrated with the end cap 6 is continuous with the inner surface 4*s* of thin part 4B. And the thickness $t_A$ of thick steel pipe 9A, corresponding to part 4A, is selected to be 1.5 to 1.7 times the thickness $t_B$ of thin steel pipe 9B, corresponding to part 4B.

The yield strength of the thick steel pipe part 4A against axial compressive loads is larger than that of the thin steel pipe part 4B. If the thickness $t_A$ is more than 1.7 times the thickness $t_B$, the external steel pipe 4 becomes undesirably heavy.

In the case that the outer diameter $D_4$ of thin pipe 9B is 60.5 mm and the thickness $t_B$ is 3.2 mm, the outer diameter of the thick pipe 9A is, for example, 63.7 mm and the thickness $t_A$ thereof is 4.8 mm.

Forming two thick steel pipe parts 4A at both ends of the external pipe 4 allows plastic deformation of only the thin steel pipe part 4B under a large axial compressive force acting on the steel pipe 4. This means that the thick steel pipe part 4A only deforms elastically, thereby, suppressing unstable axially unsymmetrical deformation of the pipe 4 close to the end cap 6.

Figure 2:
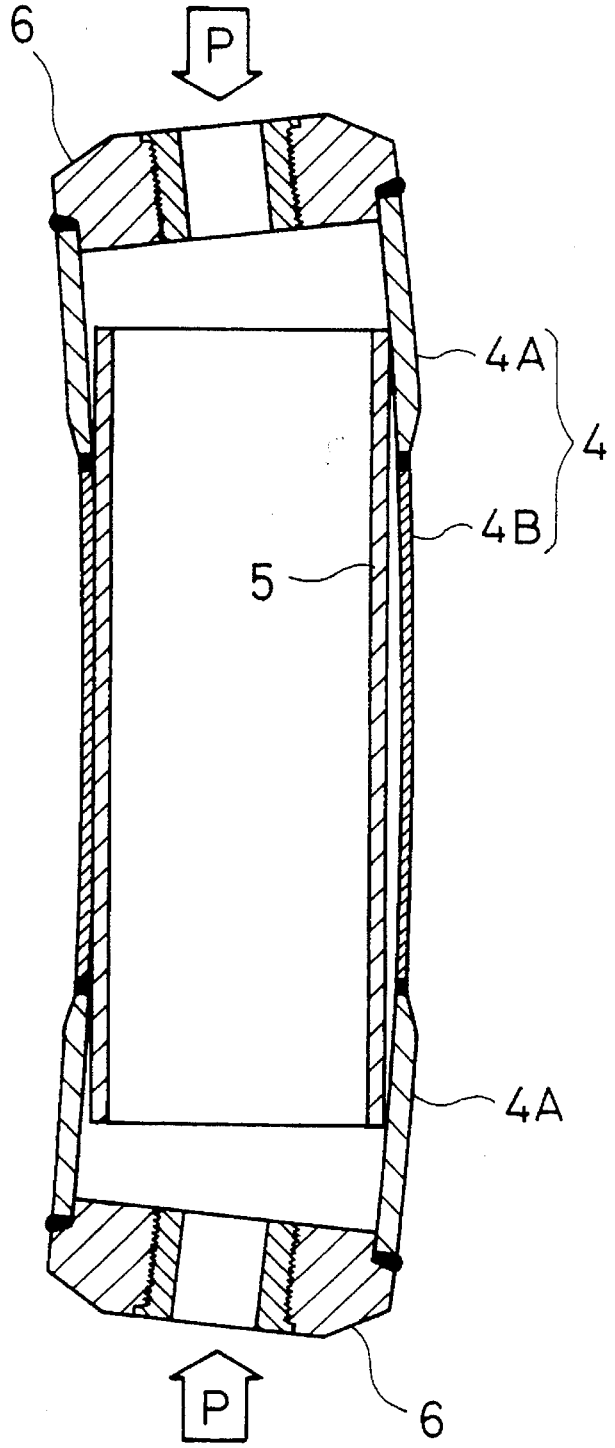
FIG. 2 is a sectional view of the double steel pipe in a state in which the resistant pipe suppresses elastic and plastic buckling of the external pipe.

The bending resistant pipe 5 is used to prevent the pipe 4 from deflecting, as shown in FIG. 2, by supporting the inner surface thereof so that the pipe 4 does not commence elastic and plastic buckling due to the axial compressive force P. The pipe 5 needs to remain straight in the pipe 4 and is shorter than the pipe 4 so that the axial compressive force P is not conveyed from pipe 4 to pipe 5.

In order to suppress the afore-mentioned elastic and plastic buckling, the bending resistant pipe 5 must be disposed not only in the elongated steel pipe part 4B but in the thick steel pipe part 4A. Therefore, the thick part 4A overlaps the resistant pipe 5 by the length L, which is one to two times the outer diameter $D_4$ of the pipe 4, as shown in FIG. 1.

The outer diameter of the resistant pipe 5 is selected so that the clearance $\alpha$ between the pipe 4 and the pipe 5 is as small as possible. For example, the inner diameter of pipe 4 is 54.1 mm and the outer diameter of pipe 5 is 53.6 mm, thereby, the clearance comes to 0.25 mm.

The clearance $\alpha$ is provided for inserting the bending resistant pipe 5 into the steel pipe 4, while allowing the pipe 5 to immediately contact with the inner surface of the pipe 4 under the axial compressive force so that the pipe 5 stiffens the inside of the pipe 4.

The small clearance $\alpha$ also contributes to restrict the inward deformation of pipe part 4B when the axial compressive load is larger than the yield strength of the pipe part 4B. Accordingly, the axial plastic deformation of pipe part 4B becomes stable since the pipe part 4B is shrunk along the outer surface of the resistant pipe 5.

The double steel pipe of the present invention facilitates the shortening of steel pipe 4 intentionally by means of plastic deformation under a big load so that the building does not collapse immediately when an earthquake or the like occurs. The strength of the resistant pipe 5 and residual strength of the external pipe 4 can resist the subsequent large load after the pipe 4 shrinks by the predetermined plastic deformation.

The pipe 5 is shorter than the external pipe 4, therefore, a space 11 exists between the end face 5*a* of the pipe 5 and the inner face 6*a* of the end cap 6. The length of space 11 is one-half of the predetermined compressive deformation allowable for the pipe 4, i.e.,$\beta/2$.

The end face 5*a* of pipe 5 moves toward the inner face 6*a* of end cap 6 under plastic deformation of the pipe 4. Then, the length of the resistant pipe 5 is defined as the difference between the overall length of pipe 4 and twice the length of the space 11. Actually, the length of pipe 4 is a little longer than the length obtained by adding the predetermined buckling length β to the length of the pipe 5 because of the welding space for the thick steel pipe part 4A and the end cap 6.

The double steel pipe is not always disposed horizontally in a space truss structure. Therefore, the resistant pipe 5 is fixed with the external pipe 4 at the intermediate portion 4*b* and 5*b* of pipes 4 and 5, respectively, by using a plug welding so that the length of one space 11 is identical to that of another space 11 on the opposite end of the double steel pipe 2.

Figure 3:
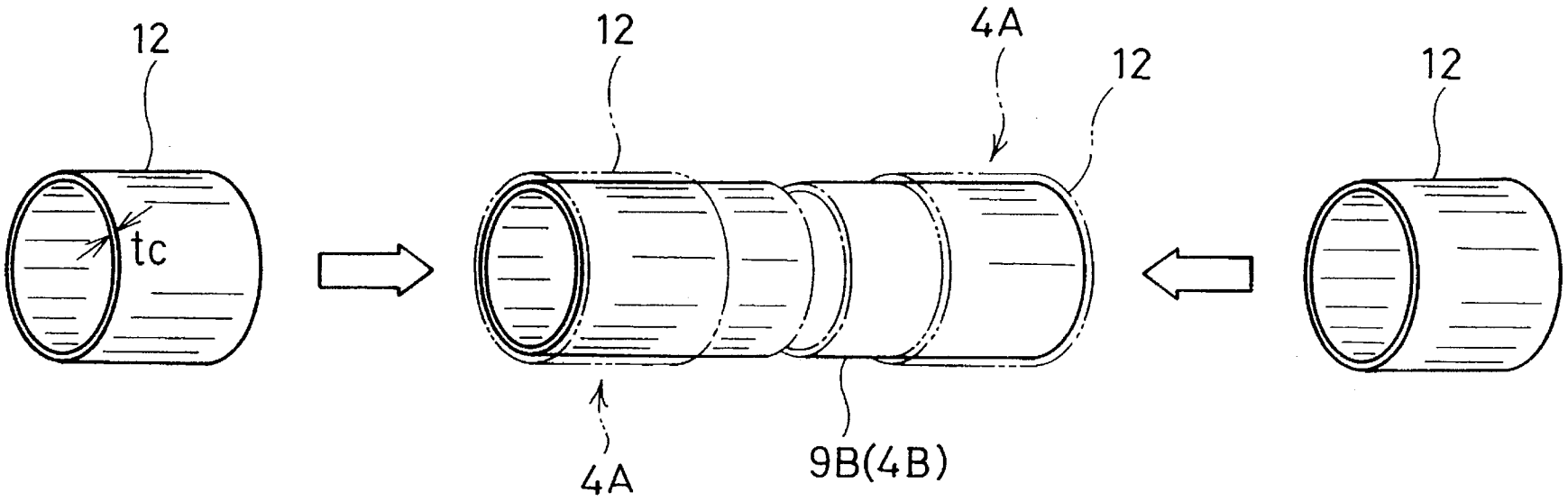
FIG. 3 is a schematic view of a double steel pipe being formed by using a reinforcing pipe for the thick steel pipe part.

The afore-mentioned thick steel pipe part 4A may by formed by a reinforcing pipe 12 covering the end portion of the elongated steel pipe 9B, as shown in FIG. 3, instead of the thick steel pipe 9A. The reinforcing pipe 12 is fixed to the pipe 9B by welding after pressurized insertion as shown by a double dotted chain line.

Figure 4:
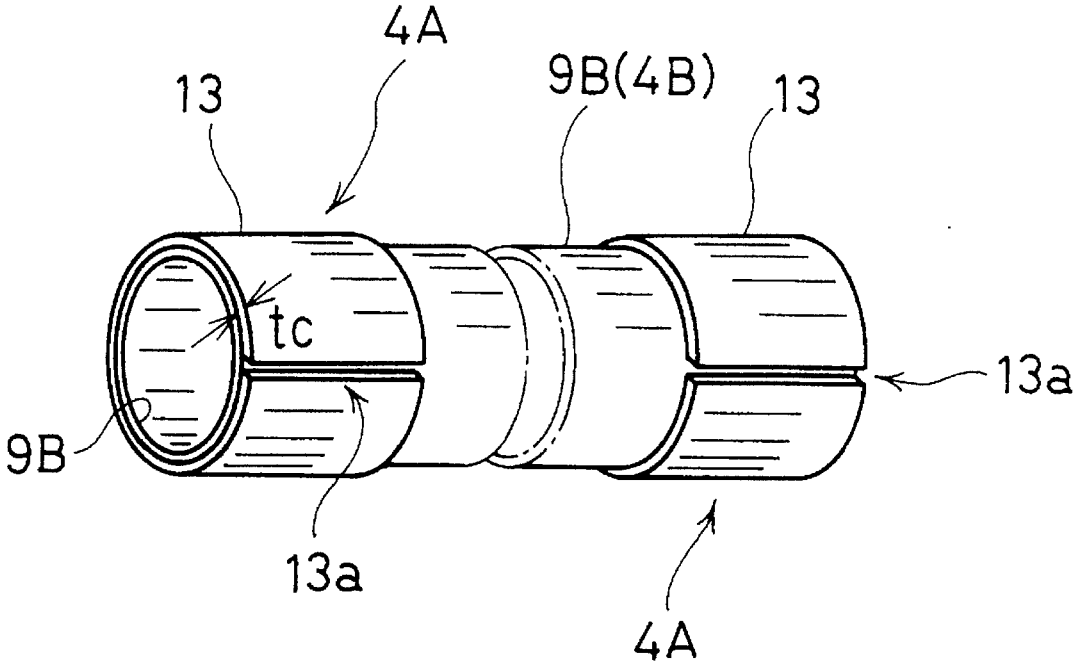
FIG. 4 is a schematic view of a double steel pipe being formed by using a circularized strip for the thick steel pipe part.

As shown in FIG. 4, a circularized strip 13 may also be used to form the thick steel pipe part 4A, which covers the end portion of the elongated steel pipe 9B. Both the edge lines 13*a* are welded in the longitudinal direction of the pipe 9B.

The thickness $t_c$ of the reinforcing pipe 12 or the circularized strip 13 is 0.5 to 0.7 times the thickness $t_B$ of the thin steel pipe 9B.

Referring to FIG. 1 again, the joint device 1 applied to the double steel pipe 2 is equipped with a fastening bolt 7 which has a first threaded part 7*a*, a second threaded part 7*b* and a polygonal swelled boss 7A formed between both threaded parts, 7*a*, 7*b*. The threaded part 7*a* is engaged with the screw hole 3*a* of the node 3 by rotating the sleeve 8 slidably engaged with the polygonal boss 7A so that the double steel pipe 2 is tightly joined to the node 3.

The afore-mentioned fastening bolt 7 is mounted on the sleeve nut 14 engaging the end cap 6 welded to the end face of the thick steel pipe part 4A. The first threaded part 7*a* of the bolt 7 is a right-handed screw and the second threaded part 7*b* is a left-handed one so that a positive rotation of the fastening bolt 7 promotes a tight engagement of an anchor nut 15 with the threaded part 7*b*.

The sleeve nut 14 is adopted for disposing the anchor nut 15 inside the pipe 4, therefore, a diameter of the internal thread 6*b* is large enough to pass the anchor nut 15 therethrough. The sleeve nut 14 may be engaged with the internal thread 6*b* after the fastening bolt, which is inserted through the sleeve nut 14, is engaged with the anchor nut 15. The nut 14 is fixed on the end cap 6 by using an adhesive material for screw locking.

The fastening bolt 7 of the joint device 1 shown in FIG. 1 is retractable into the sleeve 8. A coiled spring 16 is provided between the sleeve nut 14 and the polygonal boss 7A, which is compressed when the end of the threaded part 7*a* contacts the fastening portion 3*p* of the node 3 and biases the fastening bolt 7 toward a screw hole of the node to extend a length for an initial engagement with the node 3.

Since the detail of the structure and connecting procedure of the device 1 is disclosed in U.S. Pat. No. 4,872,779, its description is here omitted. The double steel pipe structural member of the present invention is also applicable to other well-known types of joint devices.

The double steel pipe structural member 2 is tightly connected to the node 3 by using a high tension fastening bolt 7 as described. A large axial plastic deformation of the double steel pipe 2 is achieved against the axial compressive load acting thereon.

An external steel pipe 4 is initially fabricated by welding two thick steel pipes 9A, 9A to both ends of an elongated thin steel pipe 9B. The bending resistant pipe 5 is inserted into the external pipe 4 and the intermediate portion 5*b* of the pipe 5 is fixed to the intermediate portion 4*b* of the pipe 4 by a plug welding, a small bolt or the like. Thereafter, both end caps 6, 6 are welded to each of the end faces of the pipe 4. The length of the space 11 between the end 5*a* of the bending resistant pipe 5 and the inner face 6*a* of the end cap 6 is defined as one-half of the predetermined buckling deformation β allowable for the pipe 4, for example,β/2.

Figure 5:
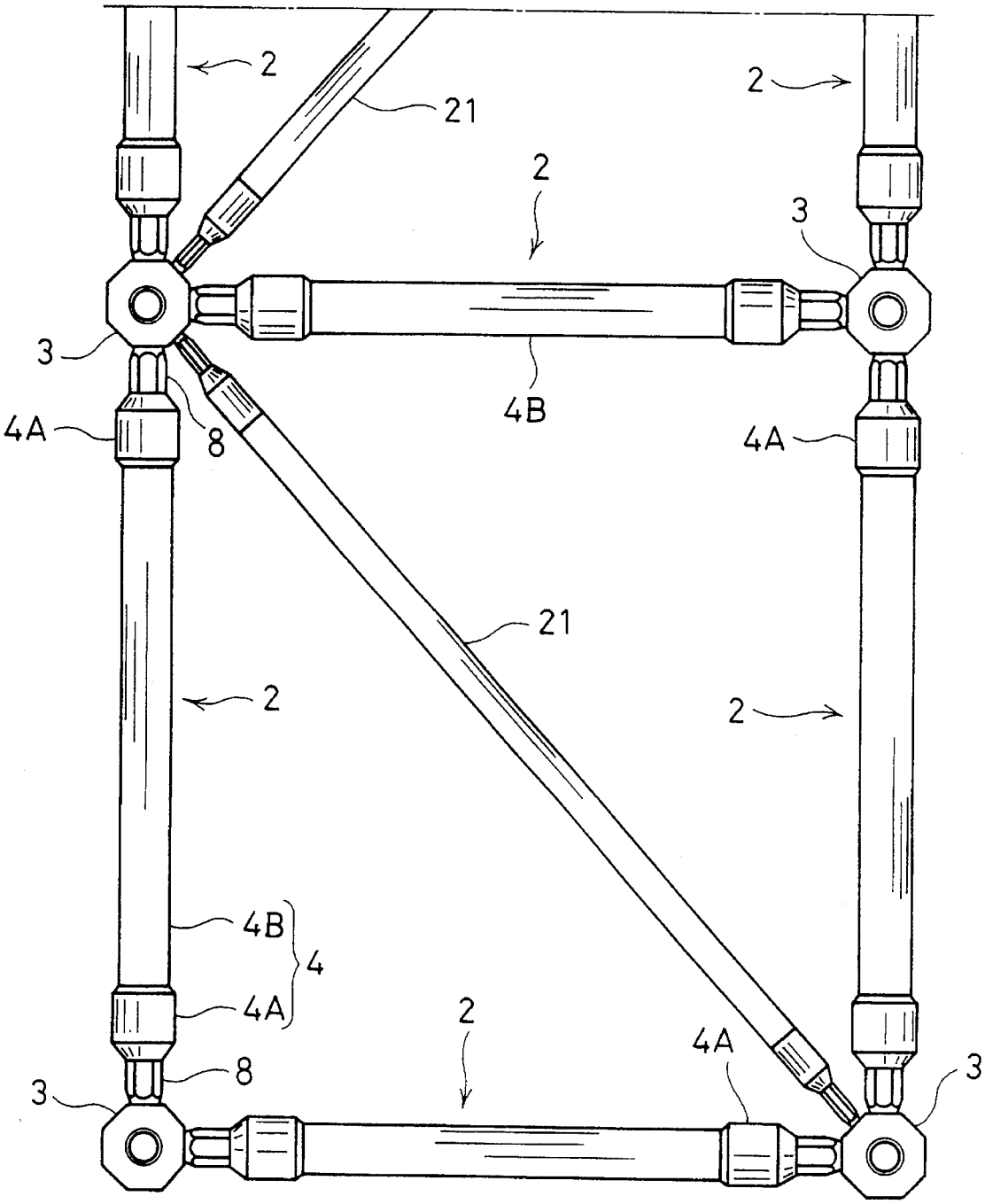
FIG. 5 is a partial view of a truss structure comprising double steel pipes and single steel pipes.

The fastening bolt 7 is mounted on the end cap 6 by using the sleeve nut 14 and is covered with sleeve 8 engaging the boss 7A. A double steel pipe 2 with joint devices is brought into contact with the node 3 when constructing the truss structure. Rotation of the sleeve 8 allows the threaded part 7*a* of the bolt 7 to engage the screw hole 3*a* of the node 3, to construct a truss structure as shown in FIG. 5 in combination with single steel pipes 21.

An earthquake, a heavy snow or the like imparts an axial load to the structural members joined to the nodes 3. A big load promotes elastic and plastic buckling of the pipe 4 as shown in FIG. 2. However, when the resistant pipe 5 remains straight it prevents the pipe 4 from deforming elastically and plastically, since the axial load is not conveyed to the pipe 5 because pipe 5 is fixed to pipe 4 at the center position of each pipe, respectively, in the longitudinal direction thereof. Therefore, the pipe 4 is not bent and withstands the load.

Figure 6:
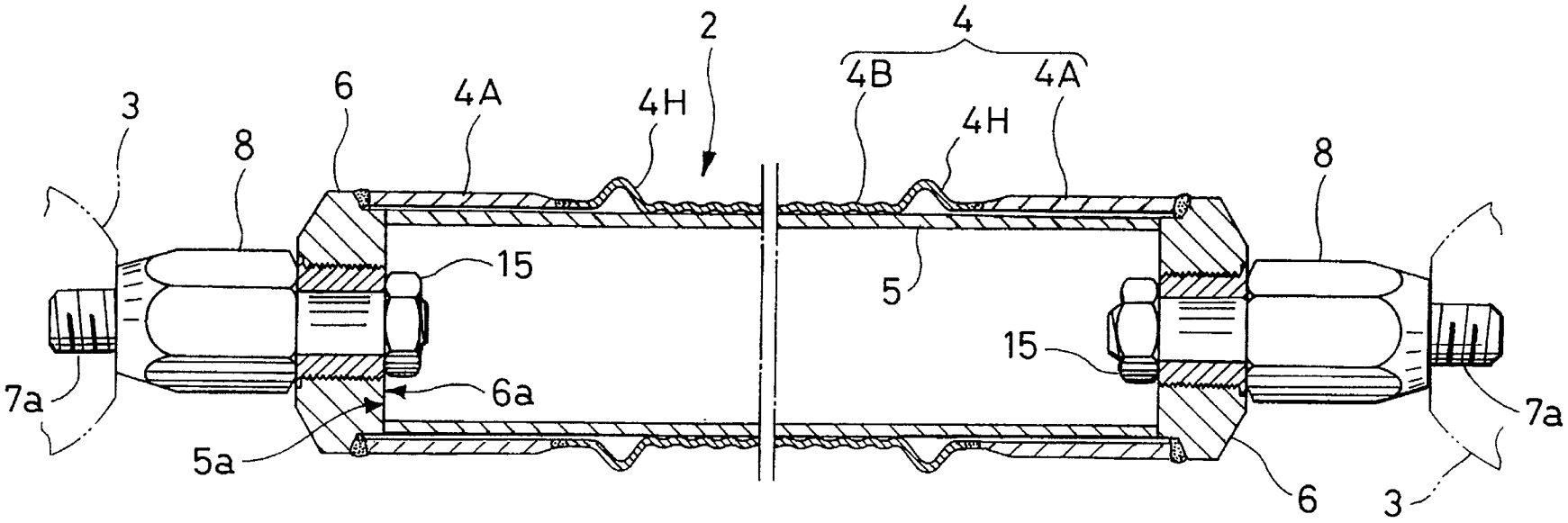
FIG. 6 is a sectional view of the generation of plastic buckling on the thin steel pipe part of the double steel pipe.

When the axial force exceeds the yield strength of the thin steel pipe part 4B, the part 4B, which is weaker than the part 4A, is deformed plastically. The resistant pipe 5 prevents the steel pipe part 4B from deforming inwardly because the clearance α is very small. The thin part 4B is obliged to deform outwardly and to wrinkle as shown in FIG. 6. The deformation on the right hand side of the double steel pipe 2 is almost identical to that on the left hand side by fixing the internal pipe 5 to the external pipe 4 at the center in the longitudinal direction of both pipes 4 and 5.

A large deformation 4H of the thin part 4B occurs at the weakest portion of the thin part 4B close to the end cap 6 and the pipe 4 is shrunk by the predetermined compressible length B along the outer surface of the resistant pipe 5. The end cap 6 is moved by eliminating the space 11 and it contacts the end face 5*a* of the internal pipe 5, because the pipe 5 is generally not moved.

Figure 11:
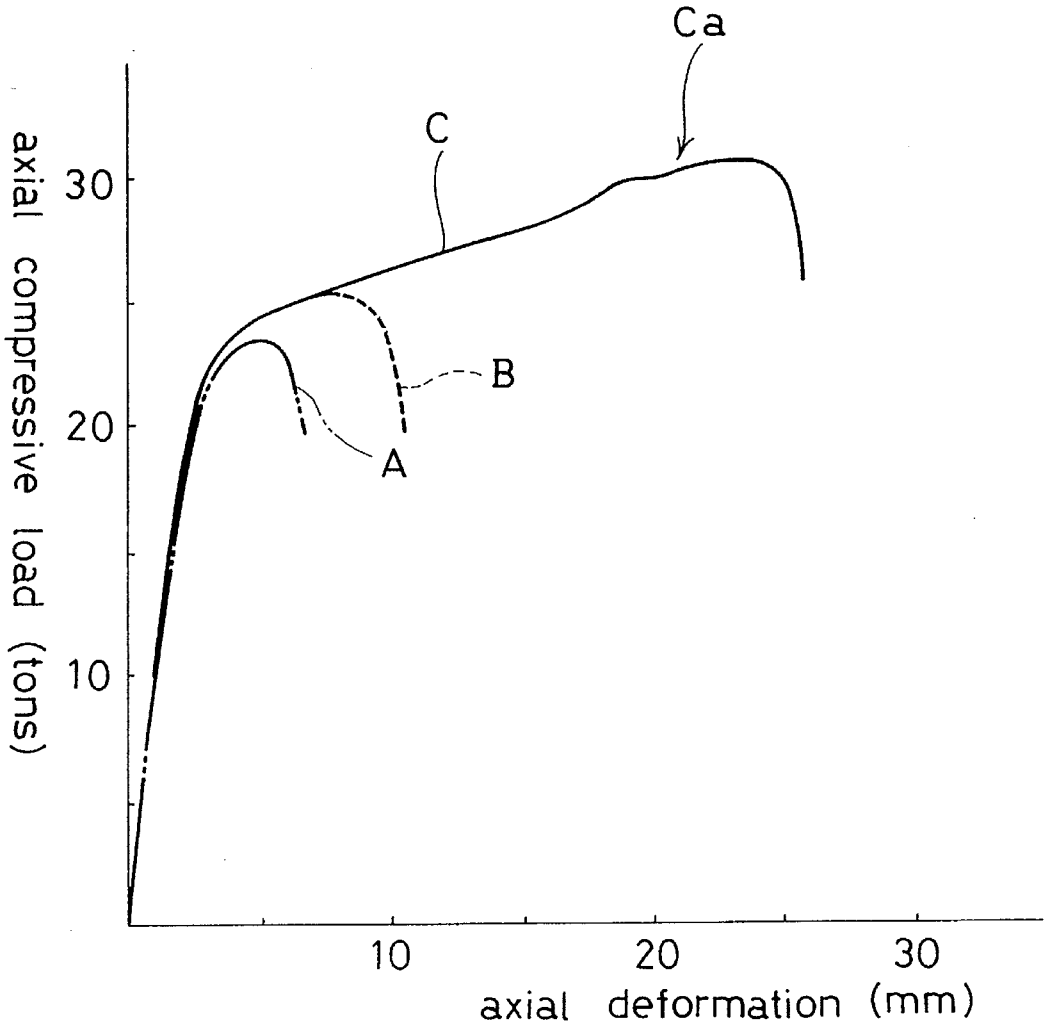
FIG. 11 is a graph showing the axial deformation plotted against the compressive load of a single pipe and a double pipe.

The plastic deformation is always exactly axially symmetrical, but the pipe 4B is bunched up around the resistant pipe 5. This deformation increases as shown by a solid line C in FIG. 11. The amount of compression of the structural member is, for example, 20 mm.

The force obtained by adding the strength of the internal pipe 5 and the residual strength of the external pipe 4 resists the succeeding axial compressive load acting on the double steel pipe 2 after the pipe 5 contacts the end cap 6. Such a deformation is slow and is maintained as shown by a solid line Ca in FIG. 11.

The shrinkage of 20 mm of pipe, as described above, is a large deformation of the truss structure, however, the structure does not collapse immediately. The occupants of the building have time to escape during deformation of the solid line Ca, even after they discover the building is deformed.

It is preferable that the inner surface 4*r* of the thick pipe 9A is continuous with the inner surface 4*s* of the thin pipe 9B. Nevertheless, it is also possible that the outer surface of the thick pipe 9A is continuous with the outer surface of the thin pipe 9B, because the thickness of pipe 9A is merely 1.5 to 1.7 times that of the pipe 9B.

In such a case, if the clearance is defined as 0.25 mm when $t_A \backslash t_B$ is 1.5, the thickness of the pipe part 4A is 4.8 mm and pipe 4B is 3.2 mm thick.

The clearance is generated 1.85 mm obtained from 4.8–3.2+0.25, thereby, the thin steel pipe part 4B may deform a little inwardly. Such an amount is negligible for the plastic deformation of the pipe part 4B around the resistant pipe 5.

Figure 7:
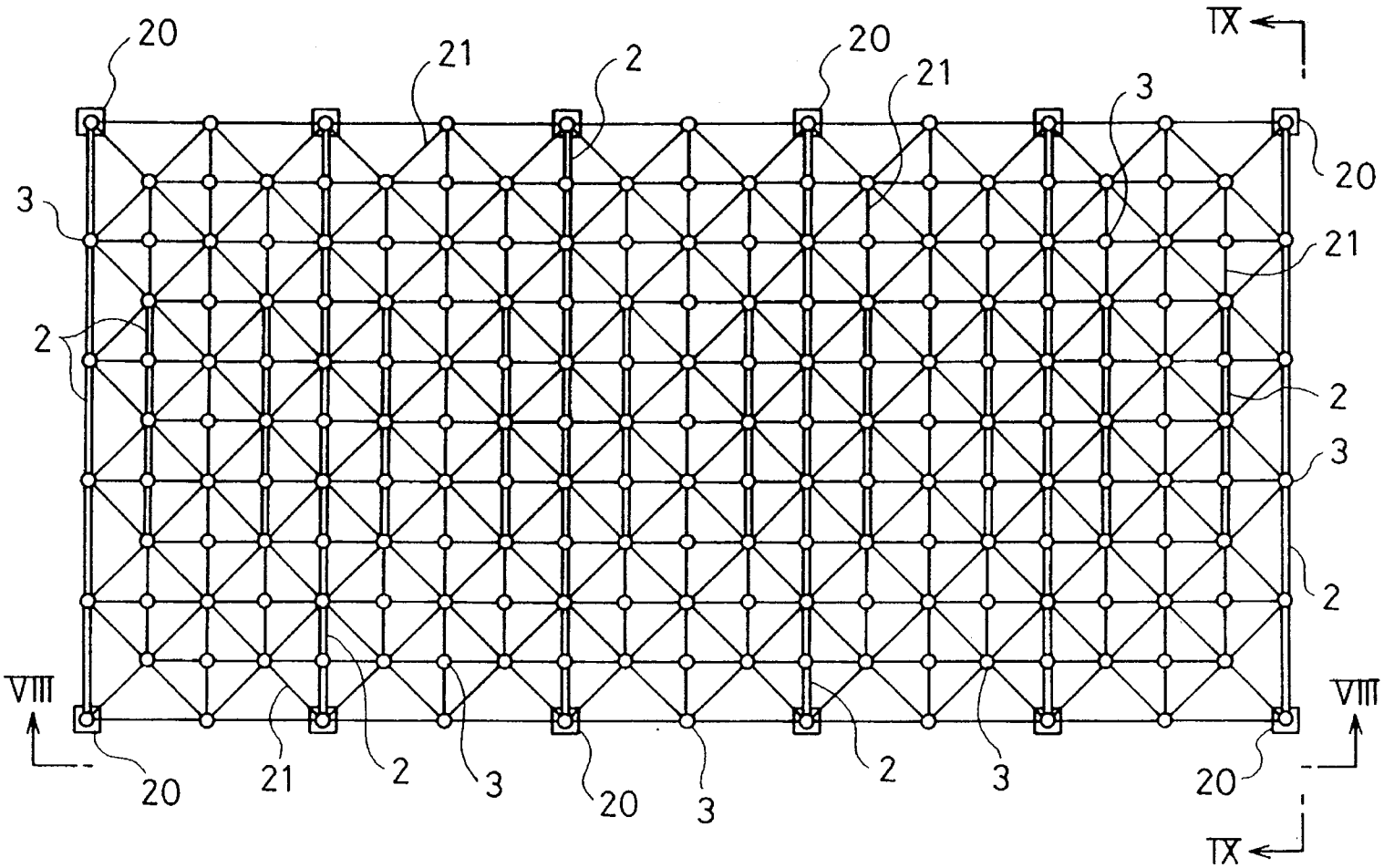
FIG. 7 is a plan view of a truss structure in which double steel pipes are applied to members facing each other.
Figure 8:
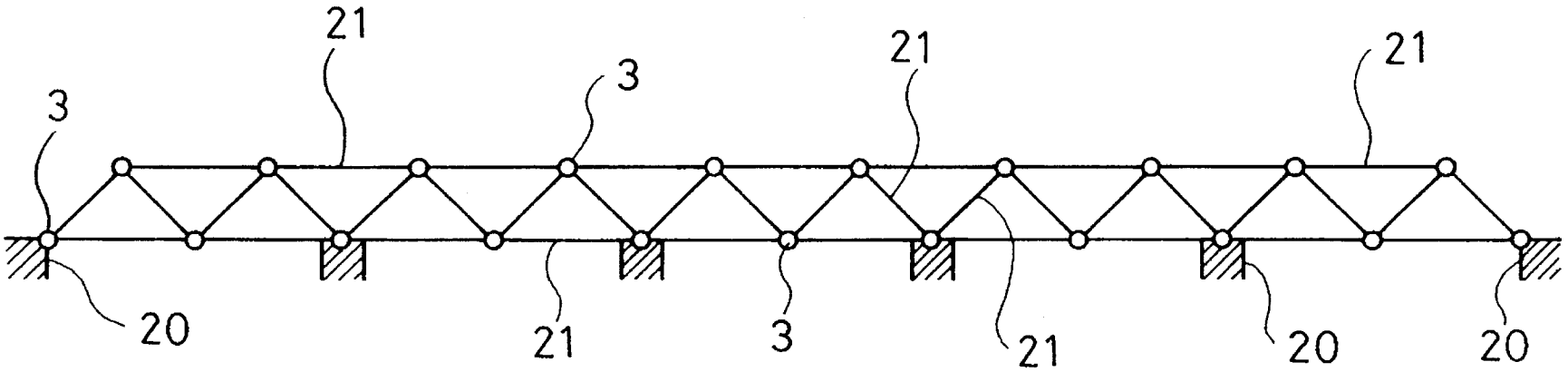
FIG. 8 is a view taken along line VIII—VIII of FIG. 7.
Figure 9:
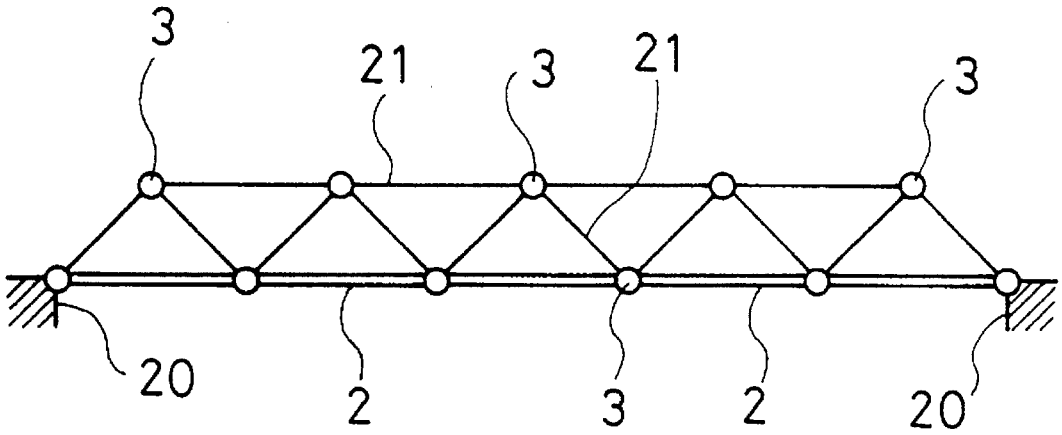
FIG. 9 is a view taken along line IX—IX of FIG. 7.
Figure 10:
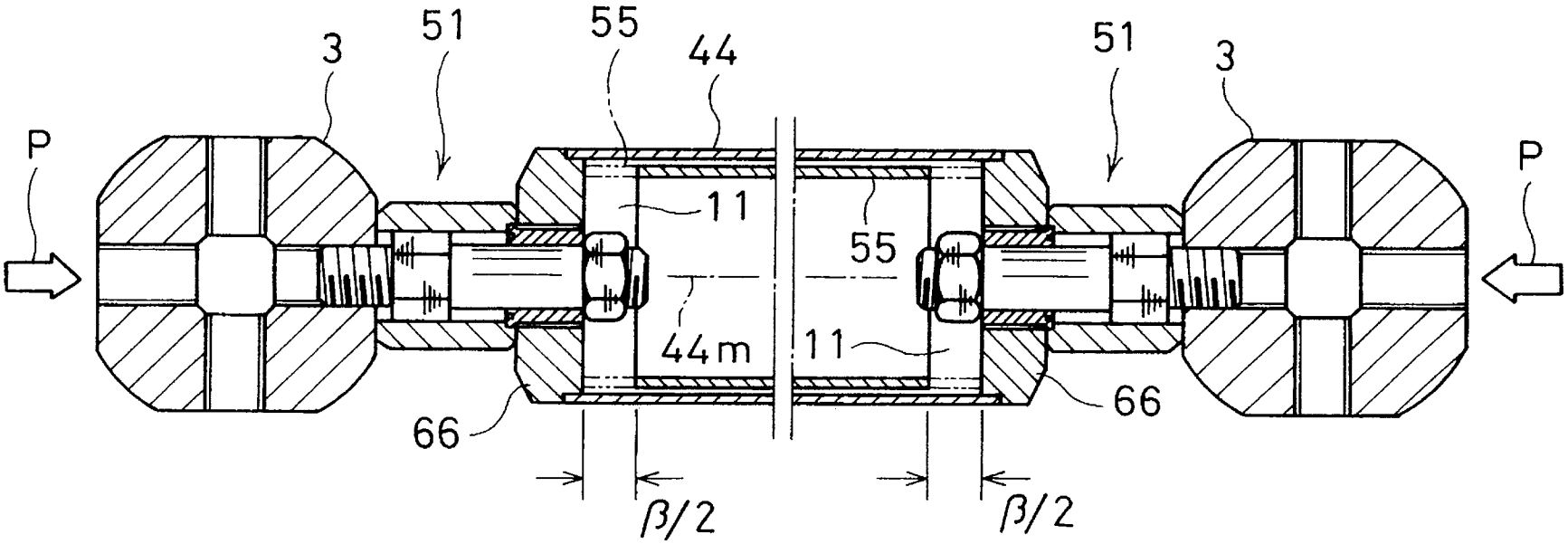
PRIOR ART FIG. 10
FIG. 10 is a sectional view of a prior art double steel pipe.

FIG. 7 shows an example applying double steel pipe to structural members facing each other in a truss structure. And FIGS. 8 and 9 are a front view and side view of FIG. 7 respectively. The members indicated by a double line are double steel pipes for carrying a heavy axial load and members indicated by a single line are conventional single steel pipes 21 for carrying a light load.

What is claimed is:

1. A double steel pipe structural member provided with an internal pipe for suppressing elastic and plastic buckling of an external pipe in response to axial compressive forces, said structural member comprising:

said external pipe comprising an elongated thin steel pipe part having a thick steel pipe part integrated with each end of said thin steel pipe part, said external pipe having an open end cap on at least one end thereof;

the thickness of said thick steel pipe part is 1.5 to 1.7 times the thickness of said thin steel pipe part;

the clearance between the outer surface of said internal pipe and the inner surface of said external pipe is as small as possible; said external pipe and said internal pipe are affixed to each other at an intermediate portion of each pipe in the longitudinal direction thereof;

the length of a space between an end face of said internal pipe and an inner face of said end cap is defined by a half of the predetermined axial compressive deformation allowable for said external pipe; and overlapped length of said thick steel pipe part with said internal pipe being one to two times the outer diameter of said external pipe.

2. A double steel pipe structural member according to claim 1, wherein:

said thick steel pipe part is formed by welding a thick steel pipe on the end of an elongated thin steel pipe.

3. A double steel pipe structural member according to claim 1, wherein:

said thick steel pipe part is formed by covering the outer surface of the end portion of an elongated thin steel pipe with a reinforcing pipe or circularized strip.

4. A double steel pipe structural member according to claim 1, wherein:

an inner diameter of said thick steel pipe part is identical to an inner diameter of the thin steel pipe part so that the inner surface of the thick steel pipe part is continuous with the inner surface of the thin steel pipe part.

* * * * *